US006452492B1

(12) United States Patent
Drury

(10) Patent No.: US 6,452,492 B1
(45) Date of Patent: Sep. 17, 2002

(54) EMERGENCY ALERT SYSTEM

(75) Inventor: William B. Drury, Henderson, KY (US)

(73) Assignee: Cable Alarm, Inc., Evansville, IN (US)

( * ) Notice: Subject to any disclaimer, the term of this patent is extended or adjusted under 35 U.S.C. 154(b) by 0 days.

(21) Appl. No.: 08/759,574

(22) Filed: Dec. 5, 1996

(51) Int. Cl.[7] ..... G08B 1/08

(52) U.S. Cl. ..... 340/533; 340/531; 340/505; 340/538; 379/39

(58) Field of Search ..... 340/533, 531, 340/512, 513, 538, 505; 379/39, 42, 43, 44, 48, 49

(56) References Cited

U.S. PATENT DOCUMENTS

| | | | | |
|---|---|---|---|---|
| 3,603,951 A | | 9/1971 | Bracken | 340/533 |
| 4,477,800 A | * | 10/1984 | O'Brien | 340/533 |
| 4,812,825 A | | 3/1989 | Kennedy | 340/533 |
| 5,029,290 A | | 7/1991 | Parsons | 340/533 |

* cited by examiner

*Primary Examiner*—Daryl Pope
(74) *Attorney, Agent, or Firm*—Gary K. Price, Esq.

(57) ABSTRACT

An alert system for providing an alert of an actual or impending emergency to homes, businesses and the like. The alert system is used in cable system network over which communication signals are transmitted to a receiver remote from the transmitter. Such communication signals have associated therewith at least one distinguishable modulation frequency. The alert system includes a mechanism for receiving an alert request and a transmitter for transmitting an alert signal in response to the alert request. The transmitter is coupled with the cable system and generates an alert signal which is modulated at a frequency distinguishable from the frequencies of the communication signals. The transmitter includes a sideband filter to reduce the subharmonics generated around the alert signal frequency. The receiver includes a mechanism for detecting a valid alert signal from the alert signal received and for generating an alarm signal therefrom. The alert system also comprises an alarm indicator connected to the receiver providing an alarm upon receipt of an alarm signal.

19 Claims, 10 Drawing Sheets

EMERGENCY ALERT SYSTEM

BACKGROUND OF THE INVENTION

1. Field of the invention

The present invention relates to an alert system, and, more particularly, to a system for alerting a wide range of homes, businesses and the like of an actual or impending emergency, such as a weather emergency.

2. Description of the related art

Today's technology makes it possible to anticipate or to be aware of and track the progress of various "emergencies" and "disasters" or impending disasters such as tornadoes, chemical spills, forest fires, floods, and the like. Though authorities, such as the National Weather Service, police and firemen, have access to the information about the disaster or an emergency, it is often difficult to disseminate the information to that portion of the public which might be affected by the emergency. Originally intended to alert the public in the event of an invasion, civil defense systems were developed and implemented earlier in this century. In metropolitan areas, civil defense systems include sirens to generate an audible alarm. The sirens are now being utilized in some locations to alert the public of a dangerous situation, such as the issuance of a tornado warning for the area.

Reliance on such sirens to alert the public has several shortcomings. First, not only is a significant portion of the general public hearing impaired, the sirens are placed in areas wherein they are only audible to a portion of the public. Also, if an individual is listening to television or stereo, or if a thunderstorm occurs at the time the sirens are activated, the sirens may not be heard. Further, sirens are not installed in all areas. Those in rural areas may not have such sirens available. Finally, it may be difficult to discern the type of emergency when the sirens are activated. An individual may be required to consult media, such as radio or television, to ascertain what is occurring and what precautionary or defensive action must be taken. It is also possible, as in the occurrence of a tornado or hurricane, for example, that electrical power has been interrupted making it difficult for the individual to consult the radio or television. Thus, it is desired to provide an emergency alert system which is effective in a wide area, is not dependent on the auditory capabilities of the individual, is capable of providing the individual with information as to the type of emergency, and which does not require the use of electrical power.

Another well-known alert system is the emergency broadcast system which was also developed to alert the public of major emergencies. Generally, however, the emergency broadcast system is not employed when a tornado warning is issued or in the event of a chemical spill, for example. Also, the individual must have access to a radio or television set to benefit from the emergency broadcast system. It is possible that the individual does not have such access or that access is essentially denied due to the loss of electrical power.

Two examples of storm warning systems are presented in U.S. Pat. Nos. 3,603,951 and 4,812,825. In the former, atmospheric disturbances, such as might be generated by a tornado, are detected by a grid of sensors which generate a radio frequency for use by receivers placed in homes, businesses, and the like. The receivers to be activated are selected based on the apparent track of the disturbance as detected by the sensors. Although the receivers do not require electrical power to operate, the system of U.S. Pat. No. 3,603,951 is limited as to the type of disaster detected. Further, placement of sensors is dependent on the location of homes and businesses in the area. If the area were to grow, additional sensors would be necessary and adjustments would need to be made in the appropriate receivers to be selected. It is therefore desired to provide an alert system which is able to easily accommodate growth and changes or additions in the locations of the homes or businesses in the area.

The tornado warning system of U.S. Pat. No. 4,812,825 includes a superheterodyne receiver which receives the amplitude modulated electromagnetic signals which are typically produced by a tornado. Upon receipt of such a signal for a sufficient amount of time, an alarm is activated.

The warning systems of U.S. Pat. Nos. 3,603,951 and 4,812,825 are limited in that they are only capable of detecting an atmospheric storm or a tornado. They do not address the need to alert the public of other emergencies such as chemical spills and forest fires. It is therefore desirable to develop an alert system which is capable of warning the public of a variety of types of emergencies. In addition, these storm warning systems may not provide sufficient warning. For example, depending on the location of the sensors in U.S. Pat. No. 3,603,951, a receiver in a home located on the edge of the grid would not be sounded until the tornado is at or very near that home, giving the occupants insufficient time to react to protect themselves. It is therefore desired to provide an emergency alert system which provides the recipient with adequate time to take precautionary or defensive action as appropriate.

The emergency alert system of U.S. Pat. No. 5,029,290 utilizes an existing telecommunications network to alert selected individuals of an emergency. The system includes a main unit located at the central office of the telecommunications company and alarm units installed in parallel with the subscriber's telephone. Authorized authorities are permitted to telephone the main unit to invoke the alert system. Codes are entered by the authority to indicate which zones are to be alerted of the emergency. To accomplish the provision of an "alarm", the telephone service to the selected individuals is interrupted. This interruption is undesirable should the individual be in the process of reporting his/her own emergency via the telephone. Also, it is possible that the individual is in the process of providing information to the appropriate authorities about the very emergency for which the telephone service was interrupted. Thus, it is desired to provide an alert system which does not interfere with the recipient's telephone service, or for that matter, with any communications media including radio and television.

In addition to the interruption of telephone service, the use of the telecommunications system for an alert system inherently causes problems. Many telephone lines are located above ground and are susceptible to interference generated by a multitude of noise sources. For example, tornados are often accompanied or preceded by storms which generate high winds, lighting, rain, and sometimes hail. The telephone lines may be electrically interfered with due to the lightning and rain, or, such lines may be downed by the high winds. Therefore, it is desired to provide an emergency alert system which utilizes a transmission medium which is less susceptible to interruption than is a telecommunications system.

Another shortcoming of the alert system of U.S. Pat. No. 5,029,290 is that, from the recipient's perspective, the system does not identify the type of emergency occurring. Thus, the individual must consult radio, television, or use the telephone system to find out more information about the emergency. Though the telephone service is intermittently available to the individual between alarms which occur every few minutes, so that only short telephone calls may be made and received during the interim periods, it is most likely that the individual will consult radio or television for further information. It is therefore desired to provide an emergency alert system which does not require that radio and television be consulted to ascertain the type of emergency as these devices may not be available or power to the devices may be interrupted.

SUMMARY OF THE INVENTION

The present invention provides an alert system for alerting businesses, homes and the like of an actual or impending emergency or disaster. The alert system is used in conjunction with a cable system network, such as that of a cable television provider. The signal generated by the transmitter of the alert system is non-intrusive, i.e., it does not interfere with the normal reception by receiving devices, such as televisions, connected to the cable system network. Mechanisms are provided to allow certain recipients to be made aware of the emergency and for informing those recipients of the type of emergency. In this manner, only those recipients who need to be apprised of the emergency are forewarned, and the warned recipient will know what type of precautionary or defensive measures should be taken for the protection of the recipient.

The invention comprises, in one form thereof, an alert system for use with a cable system network. The cable system network comprises a plurality of co-axial cables over which communication signals are transmitted. Each communication signal has associated therewith at least one distinguishable modulation frequency. The alert system includes a means for receiving an alert request indicative of an actual or impending emergency. The alert system also includes a means for transmitting an alert signal in response to the alert request. The transmitting means is operatively connected to the request receiving means and to the cable system network. The alert signals are transmitted at a modulation frequency which is distinguishable from the modulation frequencies of the communication signals. In this manner, the alert signal does not interfere with the transmission and receipt of the communication signals of the cable system network.

The alert system also includes a receiver for receiving the transmitted alert signal and for generating an alarm signal upon detection of a valid alert signal. The receiver is coupled with the cable system network remote from the transmitting means and is also operatively connected to an alarm indicating means. Upon receipt of an alarm signal and detection that the alarm signal is valid, the receiver generates an alarm signal. The alarm signal is received by the alarm indicating means for provision of an alarm upon receipt of the valid alarm signal.

In one embodiment thereof, the receiver of the alert system has associated therewith a receiver address code and the alert request includes a request that alarms be indicated only for receivers having a specified receiver address code. Accordingly, the alert signal includes an address code corresponding to the specified receiver address code. In this embodiment, the detection means of the receiver also includes a means for comparing the address code of the alert signal to the receiver address code such that an alarm signal is only generated if the address code of the alert signal and the receiver address code are equivalent. In this manner, only those recipients who should be informed of the emergency are so apprised.

In another embodiment thereof, the alert request includes an indication of the type of alert (the type of emergency) and, accordingly, the alert signal comprises an alert code representative of the type of alert received by the request receiving means. The alarm indicating means of this embodiment includes a plurality of alarms, wherein each alarm is indicative of a particular type of alert. The alarm signal generated by the receiver is specific to one of the alarms of the alarm indicating means such that only the alarm corresponding to the alert code is activated. This allows the alert system to inform the recipient of the type of emergency to thereby permit the recipient to take immediate and appropriate precautionary or defensive measures for the recipient's protection.

In one form thereof, the request receiving means of the present invention comprises a keypad for entry of an alert signal. In another form thereof, the request receiving means comprises telephonic equipment for handling remote alert requests. The telephone equipment includes a receiver for receiving an incoming telephone call, a means for prompting the caller to enter appropriate codes indicative of an alert request, and a means for converting the entered codes into an alert request. The former form of the request receiving means allows an operator in proximity to the transmitter of the alert system to activate the system. The latter form permits activation of the system by operators located remote from the transmitter. It may be desirable for both forms to co-exist.

In another embodiment of the present invention, the request receiving means further includes a security means. The security means prohibits entry of an alert signal unless a valid security code is first received by the request receiving means. The security means ensures that only intentional alert requests are made by authorized personnel.

In one embodiment, the alert system of the present invention includes a battery which is electrically connected to the receiver and to the alarm indicating means for the provision of electrical power thereto. Use of battery power allows an alarm to be indicated when electrical power to the recipient's abode is interrupted.

In another embodiment, the alert system of the present invention also includes a manually actuable initiating means, such as a switch, which is operatively connected to the transmitting means. When the initiating means is actuated, the transmitting means transmits a continuous alert signal for activation of the alarm indicating means by the receiver. When the initiating means is not actuated, no alert signal is transmitted by the transmitting means. In this manner, the alarm indicating means is interactively activated by an operator having control of the activation of the initiating means.

In another form thereof, the invention comprises a method for alerting recipients of an actual or impending emergency. First, an alert request is generated. The alert request is then transmitted as an alert signal over a cable system network by a transmitter connected thereto. The alert signal is received by a receiver located in a location remote from the transmitter and also operatively connected to the cable system network. In response to the received alert signal, an alarm indicating means is activated to thereby alert the recipient of an alert condition.

An advantage of the present invention is that it may be employed to cover a wide geographic area while permitting only certain zones within that area to be alerted of an emergency.

Another advantage of the present invention is that it easily accommodates changes or additions in the locations of the receivers in the geographical area.

Yet another advantage of the present invention is that it is not dependent on the auditory capabilities of the individual.

Still another advantage of the present invention is that the receivers do not require electrical power to operate and which inform the recipient of the type of emergency.

Another advantage of the present invention is that it provides the recipient with sufficient time to take appropriate precautionary or defensive actions based on the nature of the emergency.

Yet another advantage of the alert system of the present invention is that it utilizes a transmission medium which is less susceptible to interruption than other transmission media, such as telecommunications networks.

Still another advantage of the present invention is that it does not interrupt the recipient's service to the use of communications media such television, radio, or the telephone.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
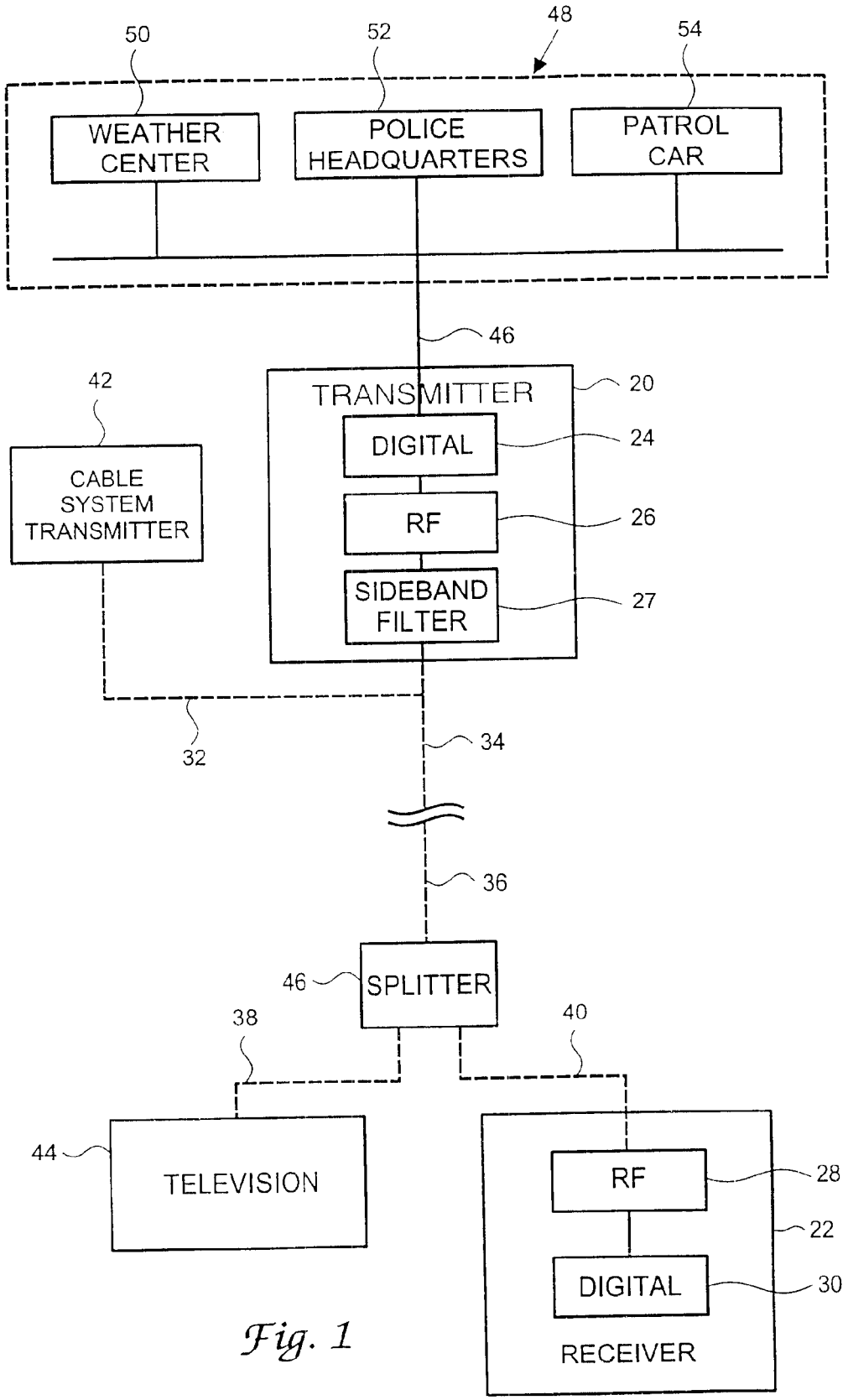
FIG. 1 is block diagram of one embodiment of the alert system of the present invention as installed in a cable system network.

Corresponding reference characters indicate corresponding parts throughout the several drawings. The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawings and particularly to FIG. 1, there is shown a block diagram of an embodiment of the alert system of the present invention as installed in a cable system network. The elements of the alert system shown in this illustration are transmitter 20 and receiver 22. Transmitter 20 is comprised of digital transmitter circuitry 24, RF transmitter circuitry 26, and sideband filter circuitry 27 which are electrically connected to each other. Receiver 22 comprises RF receiver circuitry 28 and digital receiver circuitry 30 which are electrically connected to each other. Digital circuitries 24 and 30 and RF circuitries 26 and 28 are explained in greater detail herein below.

Both transmitter 20 and receiver 22 are connected to a cable system network which comprises a plurality of co-axial cables 32, 34 and 36 through which communication signals are transmitted. The communication signals transmitted by cable system transmitter 42 have associated therewith at least one distinguishable modulation frequency so that the communication signals are correctly separated and interpreted by receiving device 44 which, in this embodiment, is a television. As is explained herein, transmitter 20 generates an alert signal indicative of an actual or impending emergency over co-axial cable 34. The alert signal is modulated at a frequency which is distinguishable from the frequencies of the communication signals generated by cable system transmitter 42 over co-axial cable 32. In this manner, the communication signals may be combined with the alert signal and transmitted over the same transmission media, namely, in this embodiment, over co-axial cables 34, 36, 38, and 40, respectively, without interference of the alert signal with the communication signals. In this manner, reception by receiving device 44 of the communication signals is not interrupted or interfered with by the alert signal.

In this embodiment, cable system transmitter 42, transmitter 20, and co-axial cables 32 and 34 are likely to be installed in the cable service's central office or regional office. Co-axial cable 36 is representative of a cable serving as input to a home, business, or the like. The signals received by co-axial cable 36 are split via splitter 46 to be transmitted over both co-axial cables 38 and 40. Receiving device 44 interprets the communication signals generated by cable system transmitter 42 and ignores an alert signal generated by transmitter 20 of the alert system. Receiver 22 of the alert system interprets the alert signal generated by transmitter 20 of the alert system and ignores the communication signals generated by cable system transmitter 42.

For the purposes of requesting the generation of an alert signal, transmitter 20 is connected via telecommunications input line 46 to telecommunications network 48. In this manner, a request for an alert of actual or impending emergency may be made remotely via telecommunications network 48 from authorities, such as weather center 50, police headquarters 52 and patrol car 54. As is explained herein, transmitter 20 also includes a keypad (see FIG. 2) for entry of an alert request at the location of the transmitter.

It will be appreciated by those skilled in the art that communication signals generated by cable system transmitter 42 and an alert signal generated by transmitter 20 of the alert system of the present invention may be transmitted by media other than co-axial cable between the location of cable system transmitter 42 and transmitter 20 and the location of receiving device 44 and receiver 22. For example, microwave transmission of the signals present in second co-axial cable 34 may be utilized to transmit the communication and alert signals to a plurality of regional offices or stations prior to transmission of the signals to third co-axial cable 36 serving as input to a home or business. Such cable system transmission media are contemplated to be within the scope of the invention. Hard wiring of the cable system network via exclusive use of co-axial cable is not required.

It will also be appreciated that telecommunications input line 46 and telecommunications network 48 need not be comprised solely of conventional wiring as the transmission media for telecommunication signals. Fiber optic cabling, satellite transmission, and other media may be used and are contemplated to be within the scope of the invention.

Figure 2:
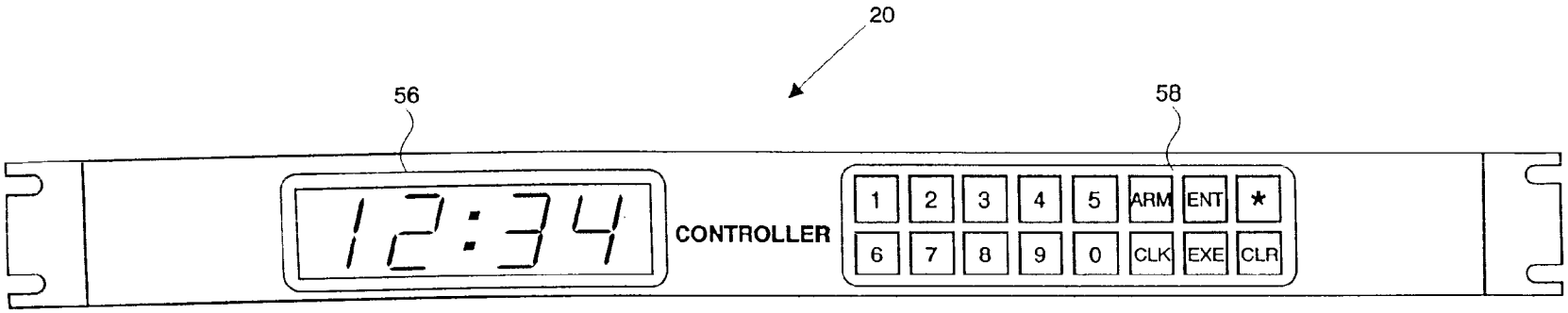
FIG. 2 is a front view of one embodiment of the transmitter of the alert system of the present invention.

FIG. 2 shows a front view of one embodiment of the transmitter of the alert system of the present invention.

Housed within transmitter 20 is digital transmitter circuitry 24, RF transmitter circuitry 26 and sideband filter 27. A schematic diagram of digital transmitter circuitry 24 is collectively shown in FIGS. 3A–3C, a schematic of RF transmitter circuitry 26 is shown in FIG. 4A and a schematic of sideband filter 27 is shown in FIG. 4B. Transmitter 20 includes digital clock 56 and keypad 58 on the face thereof. Clock 56 displays the time, in part so that an operator upon entering an alert request on keypad 58, as discussed in greater detail hereinafter, is aware of the time at which an alert signal is transmitted by transmitter 20. Keypad 58 is used to initialize clock 56 and to generate an alert request as explained in detail hereinafter. In this embodiment, clock 56 is also used to display entries made with keypad 58 when generating an alert request.

Figure 3A:
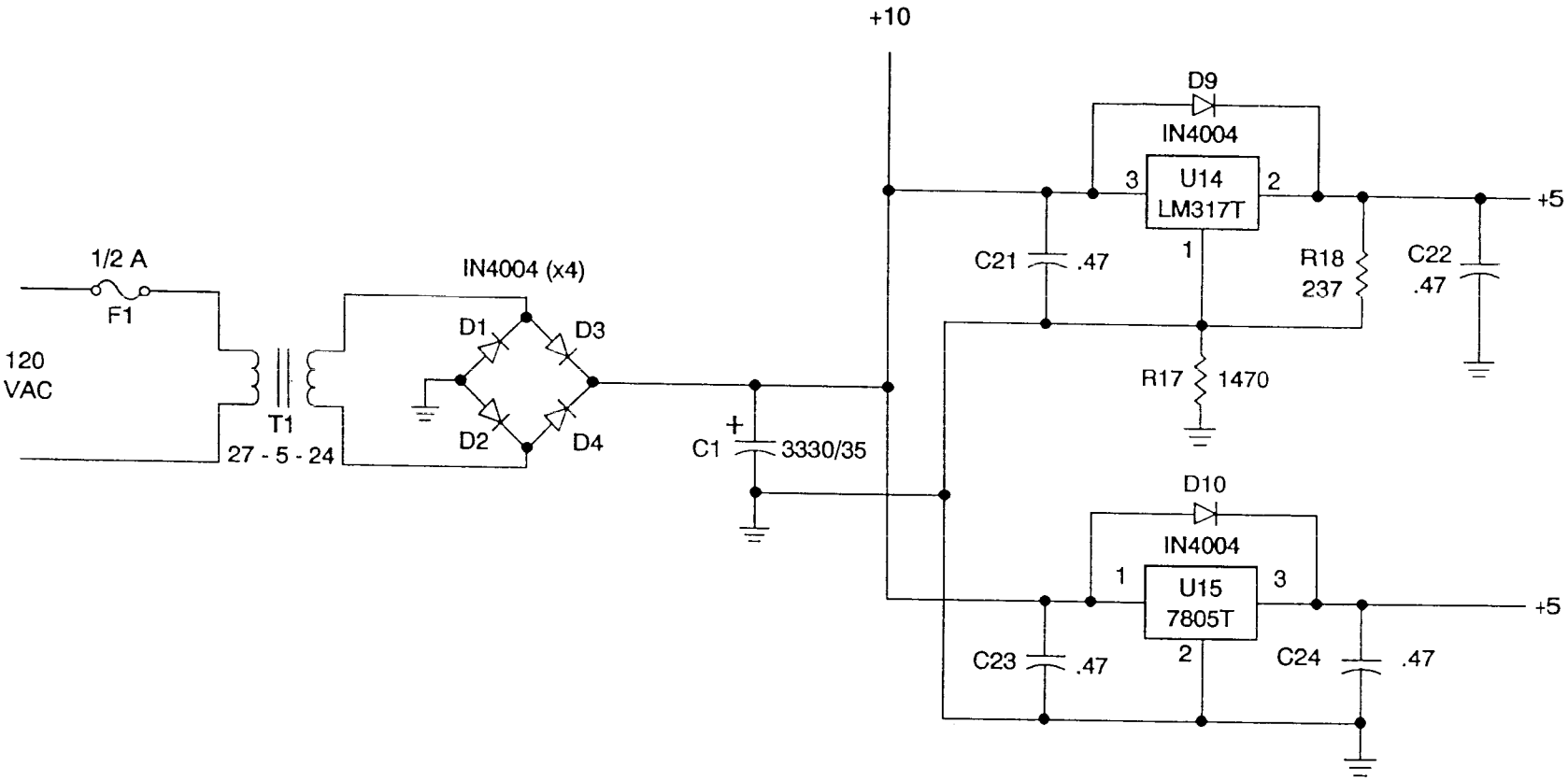
FIGS. 3A, 3B and 3C in combination are a schematic diagram of the digital portion of the transmitter of the embodiment of FIG. 2.
Figure 3B:
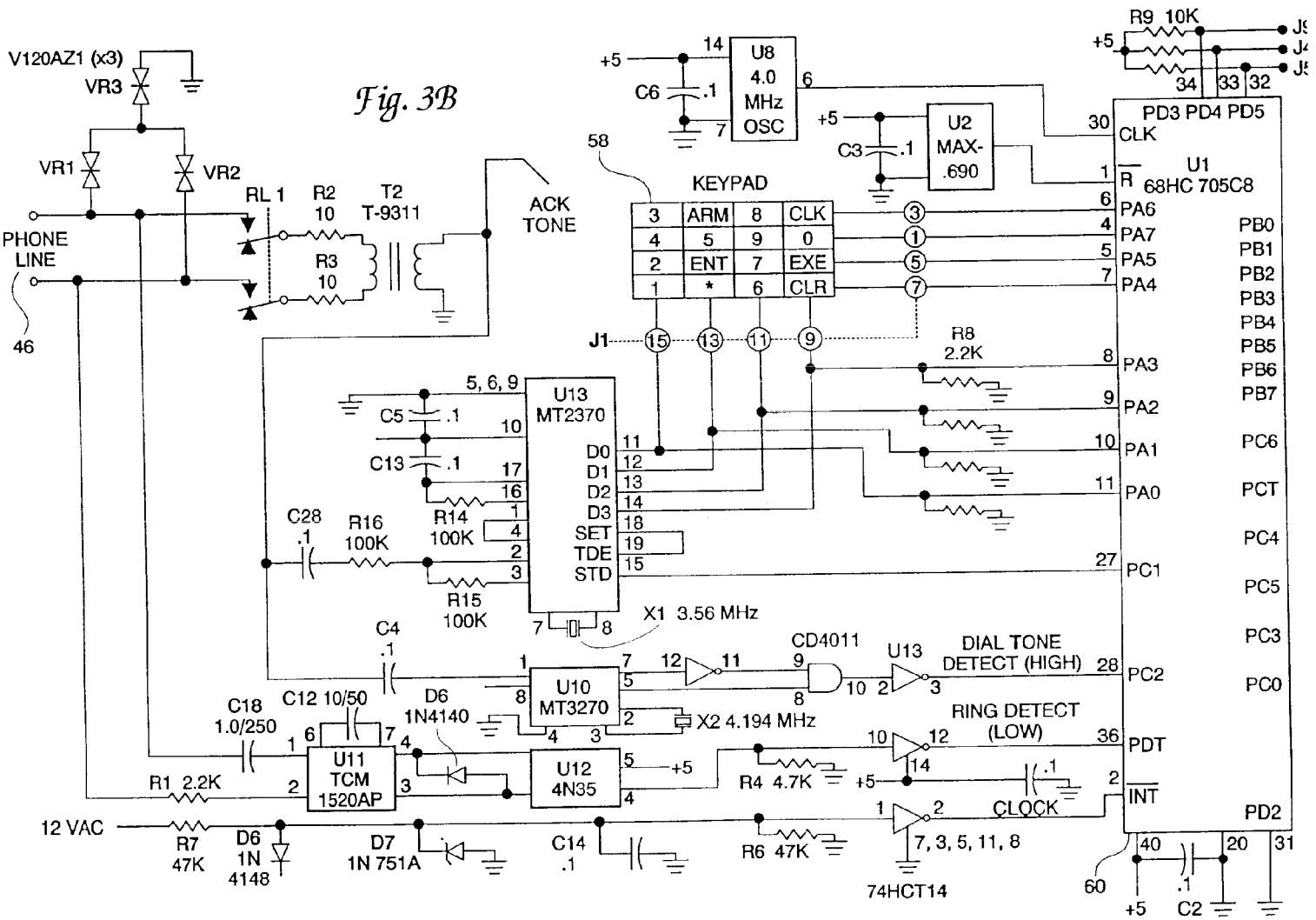
Figure 3C:
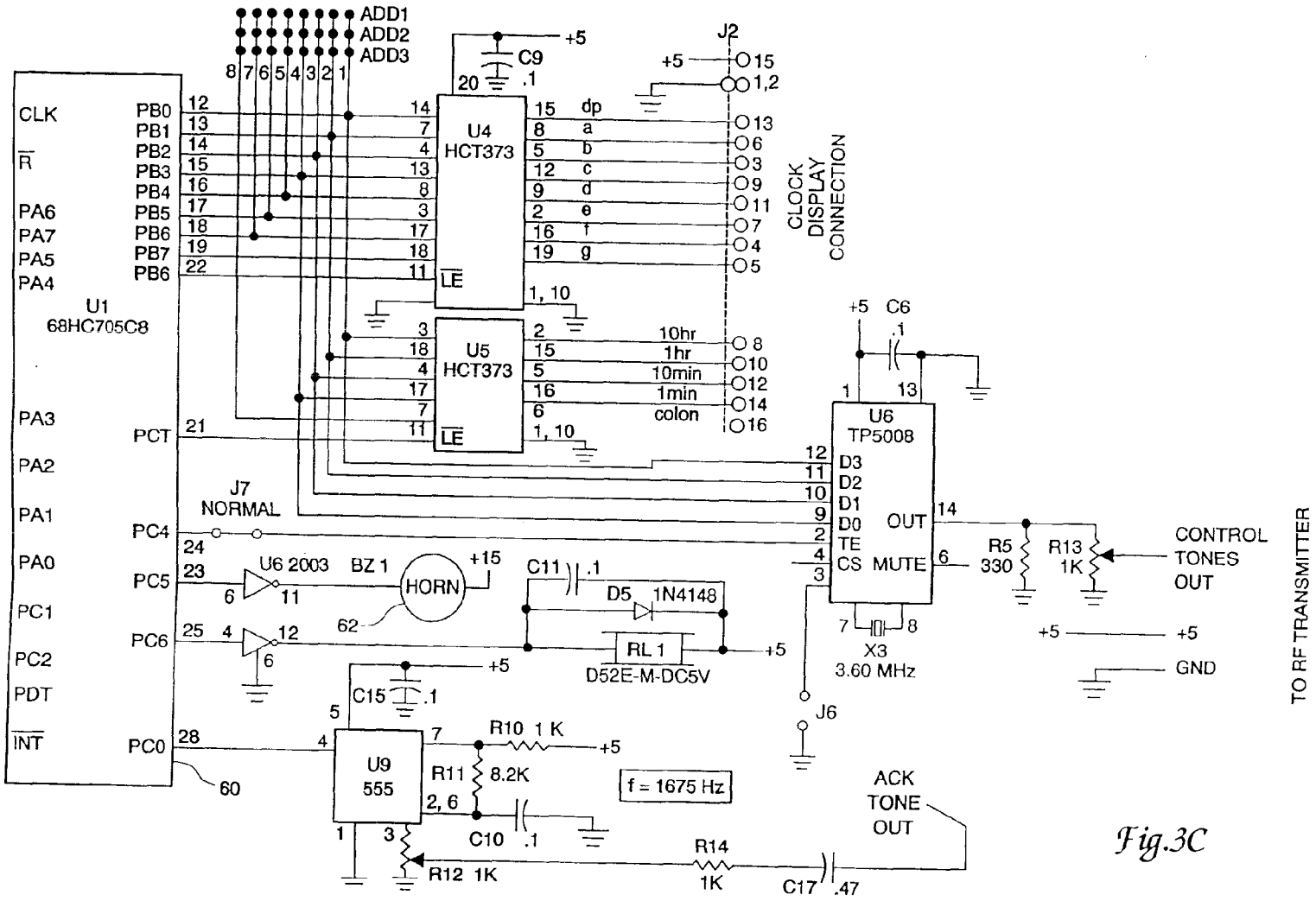
Figure 4A:
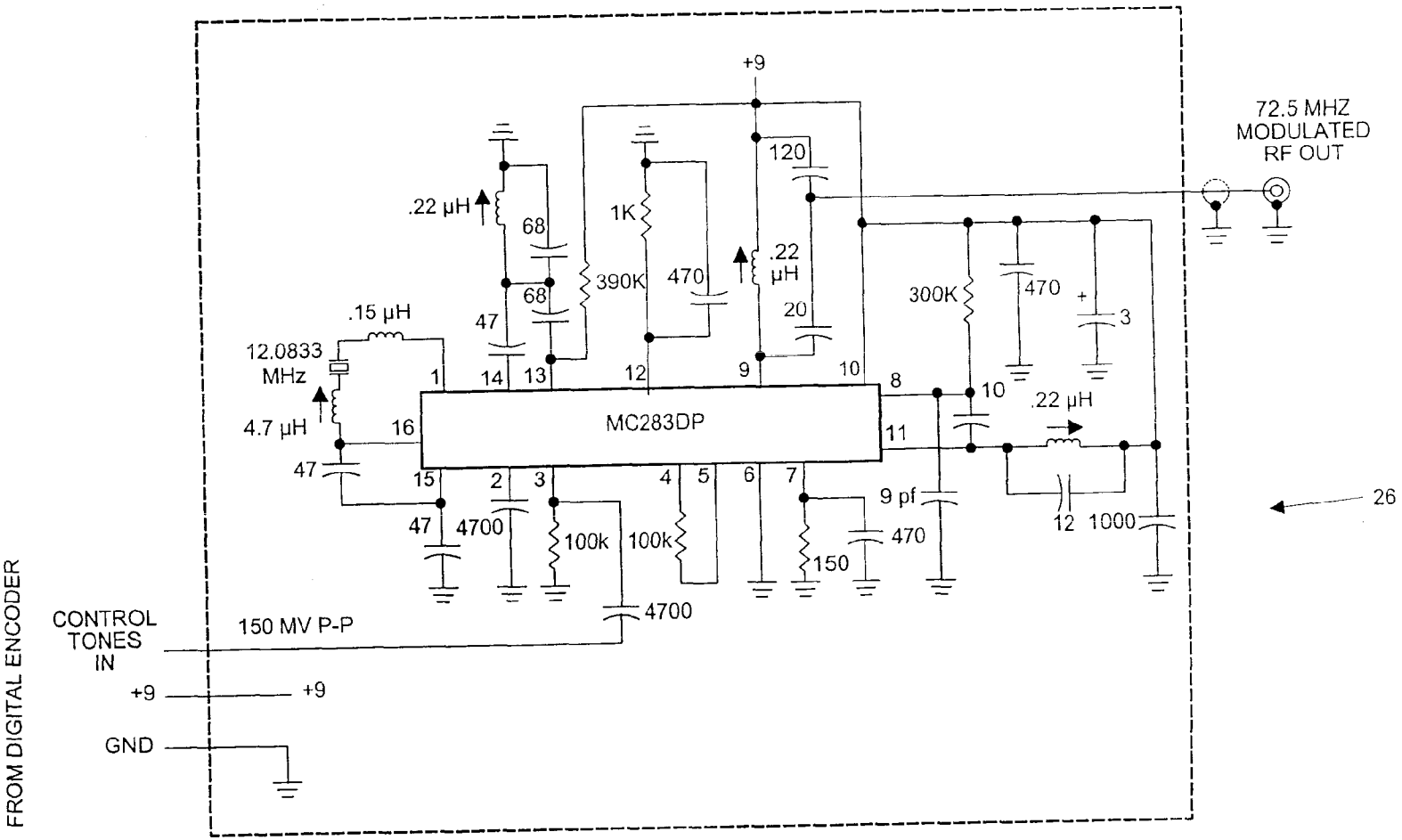
FIG. 4A is a schematic diagram of the RF portion of the transmitter of the embodiment of FIG. 2.
Figure 4B:
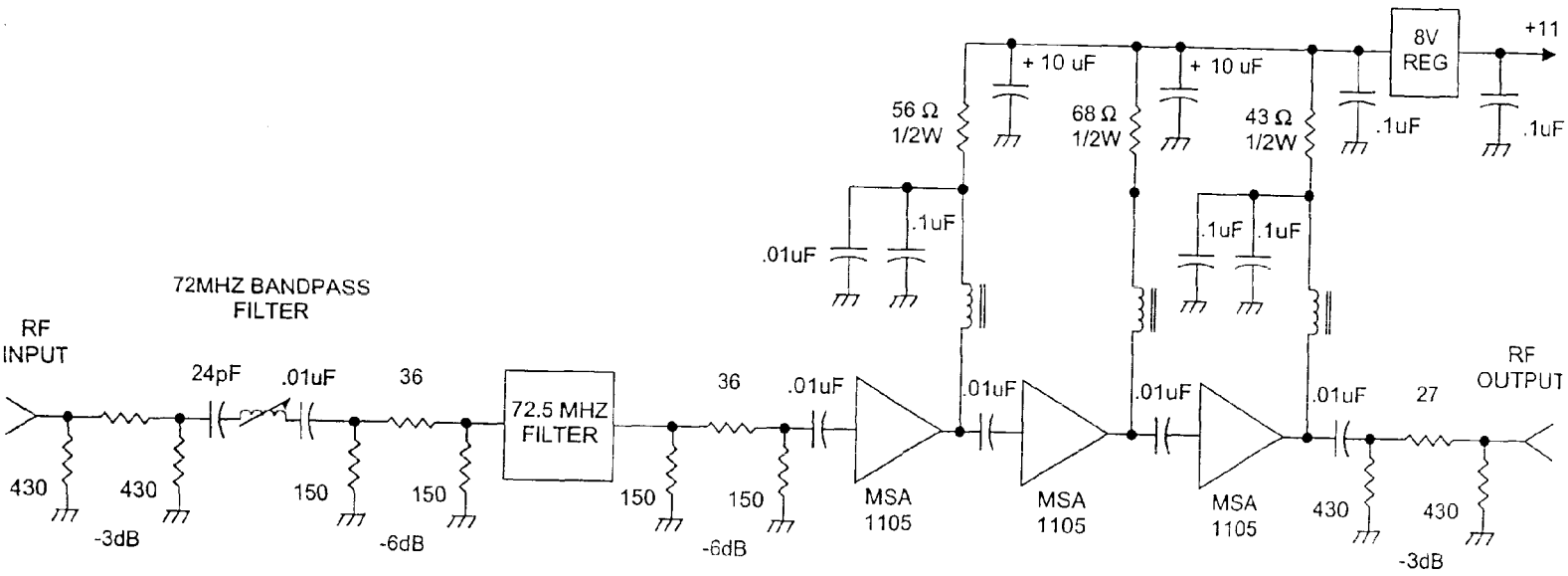
FIG. 4B is a schematic diagram of a sideband filter connected to the RF portion of FIG. 4A.

Referring now to FIGS. 3A–3C, there is collectively shown a schematic diagram of the digital portion of the transmitter of the embodiment of FIG. 2. FIG. 3A shows the power circuit for digital transmitter circuitry 24. In this embodiment, digital transmitter circuitry 24 of transmitter 20 is electrically connected to a 120 volt AC power source. The power circuit of FIG. 3A converts the 120 volt AC signal to a 5 volt DC signal.

FIG. 3B shows the portion of digital transmitter circuitry 24 wherein a phone line 46 and keypad 58 are connected to microprocessor 60. In this embodiment, microprocessor 60 comprises part No. 68HC705C8, manufactured by Motorola, Inc. The software, listed in the Appendix hereto executes on microprocessor 60. FIG. 3C shows the connection between microprocessor 60 and clock 56 of FIG. 2 through U4, and the connection between microprocessor 60 and transmitter horn 62 through U6. Also illustrated are jumper connectors J9, J4 and J5 for connection of jumpers to one of the eight pins each of ADD1, ADD2 and ADD3 which are connected to PB0 to PB7 of microprocessor 60. Placement of jumpers between J9, J4 and J5 to ADD1, ADD2 and ADD3, respectfully, establishes the password of transmitter 20 used for security purposes. Output from digital transmitter circuitry 24 are CONTROL TONES in digital form which are provided to RF transmitter circuitry 26. These CONTROL TONES include the alert code and the specified receiver address code selected either via keypad 58 or via telecommunications network 48 as previously discussed herein. Also output from digital transmitter circuitry 24 are acknowledgement tones ACK TONE OUT sent over the telephone lines when an alert request is made via the telecommunications network.

FIG. 4A shows a schematic diagram of the RF portion 26 of the transmitter of the embodiment of FIG. 2. CONTROL TONES originating in digital transmitter circuitry 24 are provided to RF transmitter circuitry 26. Output from RF transmitter circuitry 26 is an alert signal including the alert code and the specified receiver address code. In this embodiment, the alert signal is modulated at a frequency of 72.5 megahertz.

It will be appreciated by those skilled in the art that the modulation frequency of 72.5 megahertz is non-intrusive with respect to the cable system network, i.e. it does not interfere with the modulation frequencies of communication signals generated by cable system transmitter 42. It is possible that another modulation frequency is likewise non-intrusive. Any non-intrusive modulation frequency is contemplated to be within the scope of the invention, so long as the frequency may be transmitted over co-axial cable.

It will also be appreciated that it is desirable for electric power to be provided to transmitter 20 at all times to allow an alert signal to be transmitted therefrom in the event of a power interruption or power outage. Therefore, connection of transmitter 20 to a 120 volt AC supply, having a generator attached thereto in parallel may be desired. Alternatively, the power circuit of digital transmitter circuitry 24 illustrated in FIG. 3A may be modified by methods well known in the art to provide battery backup power to transmitter 20 in the event of a power outage or interruption.

FIG. 4B shows a schematic diagram of a sideband filter 27 connected to RF portion 26. Sideband filter 27 is a steep edge, crystal tuning, filter designed to eliminate the subharmonics generated by RF portion 26 around 72.5 megahertz.

Subharmonics around the desired frequency may often be generated by RF portions of transmitters and such subharmonics cause distortions to adjacent signal frequencies. Sideband filters are used to eliminate such subharmonics. Use of such sideband filters are known in the art and any conventionally known sideband filters having sufficient subharmonics elimination capability, for example, multistage LC circuits, may be used as a sideband filter 27.

Figure 5:
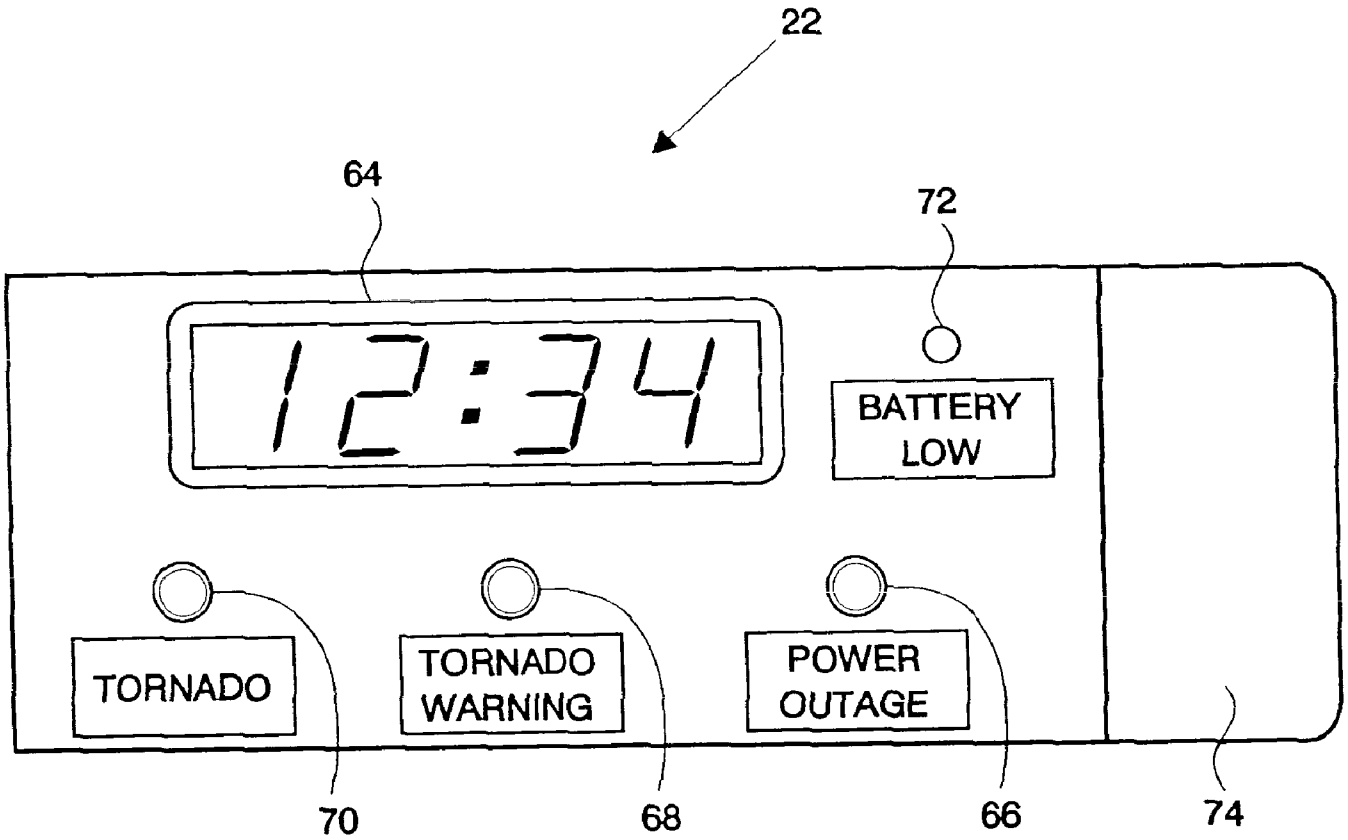
FIG. 5 is a front view of one embodiment of the receiver of the alert system of the present invention.

Referring now to FIG. 5, there is shown a front view of one embodiment of the receiver of the alert system of the present invention. In this embodiment, receiver 22 houses RF receiver circuitry 28 shown in FIG. 6 and digital receiver circuitry 30 shown in FIG. 7. Receiver 22 has receiver clock 64, power outage indication light 66, tornado warning light 68, tornado present light 70, and battery low light 72 on the front face thereof. On one side of receiver 22 is DC powered light 74.

Figure 6:
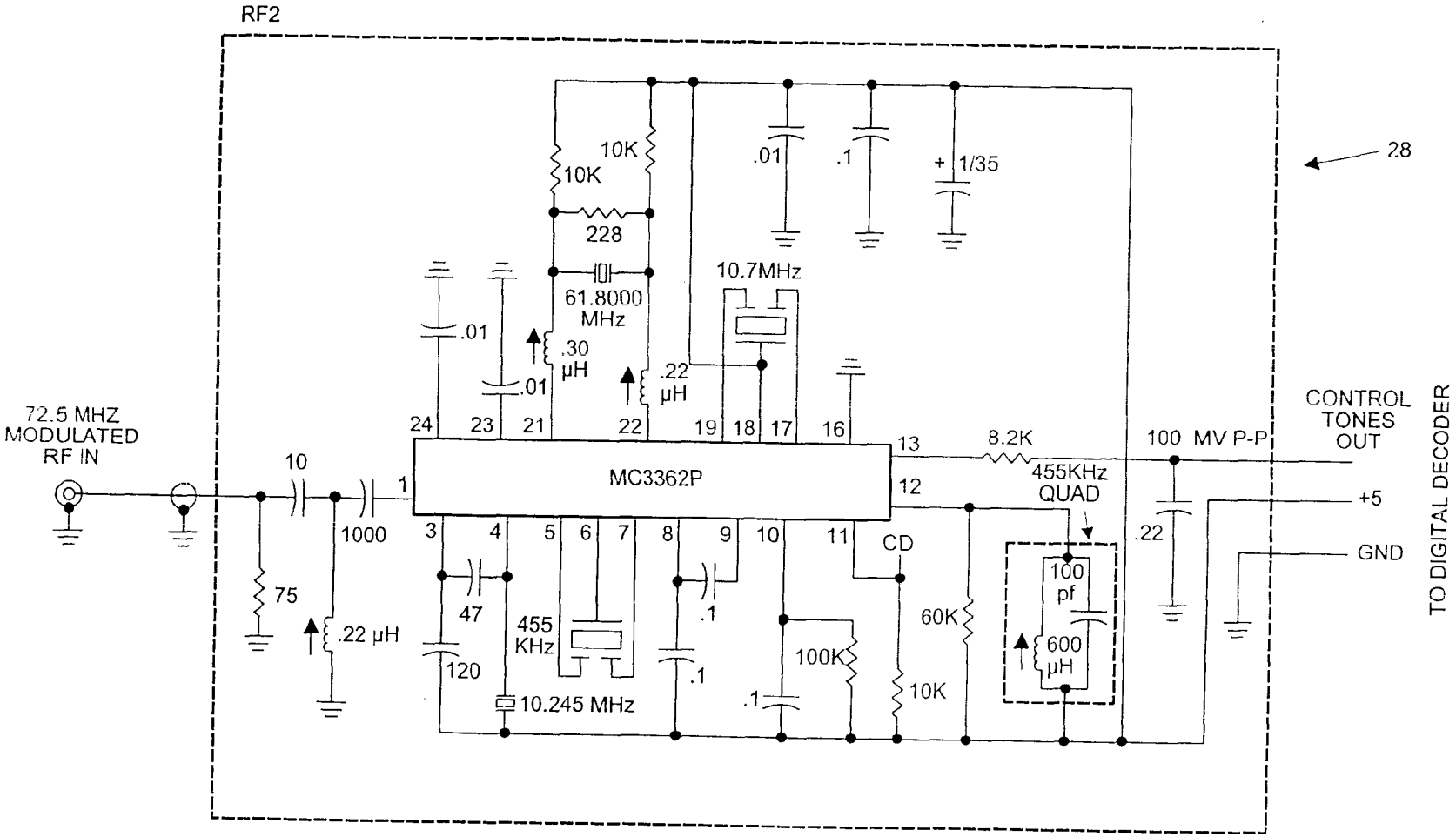
FIG. 6 is a schematic diagram of one embodiment of the RF portion of the receiver of the present invention.

FIG. 6 shows a schematic diagram of one embodiment of the RF portion of the receiver of the present invention. RF receiver circuitry 28 shown in FIG. 6 is essentially the complement of RF transmitter circuitry 26 shown in FIG. 4A. The signal input to RF receiver circuitry 28 is the output signal of RF transmitter circuitry 26. Thus, the input signal includes any alert signal generated by transmitter 20 and is modulated at 72.5 megahertz. Output from RF receiver circuitry 28 are CONTROL TONES, including tones representative of a received alert code and a received specified receiver address code. The CONTROL TONES are provided as input to digital receiver circuitry 30 shown in FIG. 7.

Figure 7:
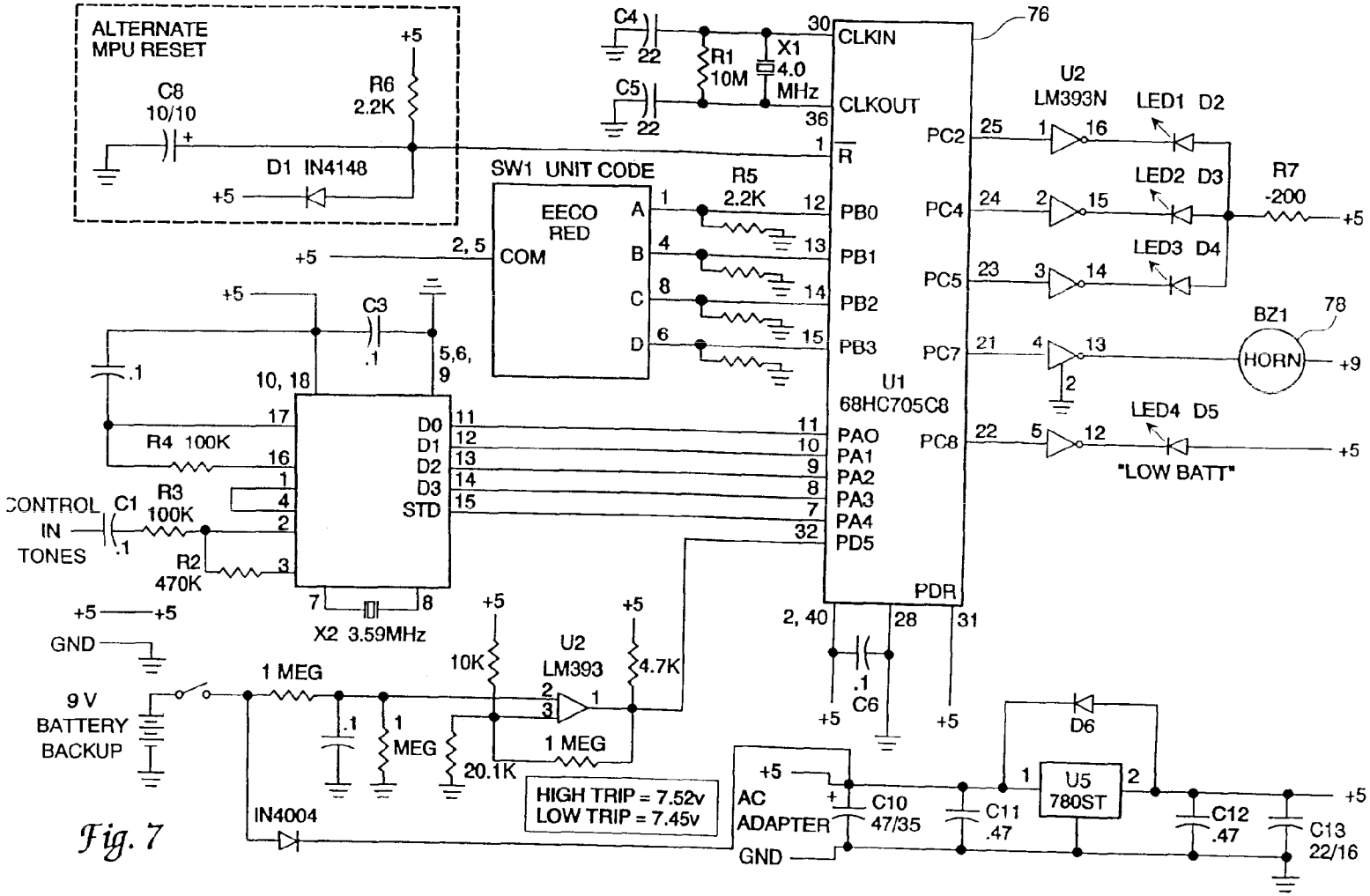
FIG. 7 is a schematic diagram of the digital portion of the receiver of the embodiment of FIG. 6.

FIG. 7 shows a schematic diagram of the digital portion of the receiver of the embodiment of FIG. 6. Digital receiver circuitry 30 is DC powered through either AC ADAPTER or through the 9 volt battery backup provided as shown. Controlling the operation of receiver 22 is microprocessor 76 which, in this embodiment, is part No. 68HC705C8, manufactured by Motorola, Inc., the same type of microprocessor utilized in digital transmitter circuitry 24. The software for execution on microprocessor 76 is attached hereto in the Appendix.

Microprocessor 76 is connected to LED1, LED2, LED3 and LED4, corresponding to power outage light 66, tornado warning light 68, tornado present light 70 and battery low light 72, respectively. In this embodiment, microprocessor 76 is also connected to receiver horn 78 for provision of an audible alarm.

As previously mentioned, transmitter 20 of the present invention may accept an alert request via keypad 58 (see FIGS. 2 and 3) or over telecommunications network 48. Also, keypad 58 is utilized to set the time displayed on digital clock 56 (see FIG. 2). The operation of transmitter 20 is described in further detail in the material following.

Upon the provision of power to transmitter 20, microprocessor 60 initializes transmitter 20. Specifically, transmitter 20 is set in its default state wherein no alert signals are transmitted and any connection with telecommunications network 48 is disconnected. Required variables are initialized, the clock time is initialized to zero, and the three-digit password established by jumpers extending from J9, J4 and J5 to ADD1, ADD2 and ADD3, respectively, (see FIG. 3C) are read by microprocessor 60 upon power up of transmitter 20.

Once transmitter 20 is initialized, microprocessor 60 monitors keypad 58 and telephone line 46. If a key depression is detected, microprocessor 60 discerns whether the key depressed is one which initiates a function of transmitter 20, otherwise, microprocessor 60 ignores the key depression. Specifically, to initiate the clock setting procedure, the CLK key must be depressed. If instead of a key depression, a ring is detected as emanating from telephone line 46, the remote arming procedure is initiated by microprocessor 60.

Considering first the clock setting procedure, as previously stated, this procedure is invoked via depression of the CLK key. It should be noted that in this embodiment, digital clock 56 is intended to be set in a 24 hour format. After microprocessor 60 detects the depression of the CLK key, microprocessor 60 sends a signal to clock 56 to cause a cursor (not shown) to flash beneath the character position to be set, beginning with the left-most character position. Depression of a number key from the "0" key to the "9" key on keypad 58 results in microprocessor 60 changing the display at the character position above the cursor to the number entered and advances the cursor to the next character position. This process is continued until all four character positions are set at which time the cursor beneath the fourth character position disappears, and the colon located between the second and third character position is caused by microprocessor 60 to flash on and off. At this point, microprocessor 60 awaits the depression of the ENT key. When microprocessor 60 detects the depression of the ENT key, the time is set to the newly entered time. If at any time during the clock setting procedure microprocessor 60 detects the depression of the CLR key, the clock setting procedure is exited and microprocessor 60 resets the time to the time displayed prior to entry into the procedure.

Keypad 58 is also used to enter an alert request. The alert request entered is transmitted as an alert signal over the cable system network to activate alarms on any receivers of the present invention connected thereto. Thus, a deliberate and definite sequence is employed for entering an alert request to prevent unnecessary or false alert signals from being transmitted by transmitter 20. At any time during the following procedure, depression of the CLR key will set transmitter 20 to its default status. Depression of the ARM key for five seconds initiates the arming sequence. Detection by microprocessor 60 of ARM key for less than five seconds does not initiate the sequence.

After ARM is pressed for five seconds, microprocessor 60 causes horn 62 of transmitter 20 to be activated to provide the operator with audible feedback that entry of an alert request is permissible. Within ten (10) seconds of the sounding of horn 62, microprocessor 60 expects the operator to enter a two-digit numeric sequence which is representative of the receiver address codes to be alerted. As explained in greater detail herein, each receiver 22 of the alert system of the present invention has a receiver code associated therewith. The numeric sequence entered is displayed by microprocessor 60 as the left-most two digits of clock 56. In this manner, the operator is able verify the entries made. In this embodiment, up to 99 address codes may be implemented. A specified receiver address code of "00" corresponds to an alert request in which all receivers are to be activated.

After entry of the specified receiver address, microprocessor 60 expects the operator enters another two-digit numeric sequence. This two-digit entry corresponds to the type of alert and the type of emergency to be transmitted. As before, entry of this sequence must be made within ten (10) seconds after entry of the specified receiver address code. Microprocessor 60 displays as the last two digits of clock 56 the alert code entered via keypad 58. In this embodiment, up to 99 alert codes may be set.

Within the next ten seconds after entry of the alert code, a microprocessor 60 awaits depression of the EXE key. Upon depression of the EXE code, microprocessor 60 generates control tones including tones representative of the specified receiver address code and the alert code. In turn, RF transmitter circuitry 26 transmits an alert signal including the entered codes over the cable system network. As is explained in further detail herein, the alert signal causes the alarm corresponding to the alert code for those receivers having the specified receiver address code to be activated. The operator may continue to depress and release the EXE button to activate and deactivate the appropriate alarms so long as no more than ten seconds elapse between successive depressions. Failure to make an appropriate entry within the ten second time window results in microprocessor 60 exiting the arming sequence and causing transmitter 20 to return to its default status.

As mentioned in association with FIG. 1, an operator may remotely enter an alert request via telecommunications network 48 to which transmitter 20 is operatively connected. When such access is used, the manual arming sequence previously discussed in utilizing keypad 58 is generally repeated. However, additional entries are required to provide security to ensure that the system is not inadvertently accessed and is not accessed by unauthorized personnel.

To initiate the process, the authorized individual telephones transmitter 20. After microprocessor 60 detects four rings, transmitter 20 answers the incoming call and then transmits a five second acknowledgement tone over telephone 46. Microprocessor 60 then expects the entry of the sequence "* * PW1, PW2, PW3*" where PW1, PW2 and PW3 correspond to the three digits of the password of transmitter 20. Transmitter 20 generates an acknowledgement tone in response to the entry of each character/number of the sequence. If an incorrect sequence or password is entered, microprocessor 60 disconnects the telephone line and returns transmitter 20 to its default state.

Within 30 seconds of the entry of the password sequence, the operator is required to enter a two-digit code corresponding to the specified receiver address code. An acknowledgement tone is transmitted over the line upon receipt of the address code. Within ten seconds thereafter, the operator is to enter the two-digit alert code. A longer acknowledgment code is transmitted over telephone line 46 upon receipt of the alert code. At this point, depression of the "*" key on the telephone has the same effect as depression of the EXE key when keypad 58 is used to enter the alert request, namely, alarms corresponding to the alert code at receivers having an address code equivalent to the specified receiver address code are activated while the "*" key is depressed. Between depressions of the "*" key, two short acknowledgment tones are sounded over telephone line 46. As before, the operator must depress the "*" key within the ten seconds of the last depression or transmitter 20 will disconnect the telephone line and place the transmitter in its default state.

Turning now to the operation of receiver 22 of the alert system of the present invention, upon the provision of power to receiver 22, microprocessor 76 initializes appropriate variables including the retrieval of the receiver address code of receiver 22. In addition, battery low light 72 is set to off and all alarm indicators (power outage light 66, tornado warning light 68, tornado light 70 and receiver horn 78) are set to off. This initialized state also corresponds to the default status of receiver 22.

Once initialized, microprocessor 76 monitors the status of the 9 volt battery to ascertain whether sufficient battery power is generated. If at any time, microprocessor 76 determines that the power of the battery is low, microprocessor 76 activates LED4 which corresponds to battery low light 72.

In addition to monitoring the power level of the battery, microprocessor 76 simultaneously scans the CONTROL TONES IN input of digital receiver circuitry 30 for the presence of control tones. The CONTROL TONES IN signal comprises CONTROL TONES which are generated by RF receiver circuitry 28 in response to the receipt of an alert signal generated by transmitter 20. The CONTROL TONES include a specified receiver address code and an alert code corresponding to the codes generated by transmitter 20 as previously described.

When CONTROL TONES are detected by microprocessor 76, microprocessor 76 compares the specified receiver address code to the receiver address code of receiver 22. If the specified address code is equivalent to the receiver address code, microprocessor 76 then analyzes the alert code. In this embodiment, a specified receiver address code of "00" is used to indicate that all receivers connected to the cable system network are to be activated. Therefore, microprocessor 76 also proceeds to analyze the alert code if the specified receiver address code is "00". If the specified receiver address code is not equivalent to the receiver address code or is not "00", microprocessor 76 resets receiver 22 to its default status.

If a valid specified receiver address code is detected, microprocessor 76 analyzes the alert code. In this embodiment, alert codes of "0", "1" and "2" are valid, with each code corresponding to the power outage, tornado warning, and tornado conditions, respectively. Upon determination by microprocessor 76 that a valid alert code (i.e., "0", "1" or "2") was received, the respective LED (LED1, LED2 OR LED3; respectively) is activated by microprocessor 76 and receiver horn 78 is sounded. In this embodiment, the respective LED is caused to flash on and off. However, activation may also result in the constant illumination of the LED.

Activation of the appropriate LED and receiver horn 78 continues until control tones cease to be received by microprocessor 76. Upon cessation of the control tones, microprocessor 76 resets receiver 22 to its default status, deactivates the appropriate LED and receiver horn 78, and continues to monitor the CONTROL TONES IN input for receipt of CONTROL TONES.

It will be appreciated by those skilled in the art that the alert system of the present invention is interactive, i.e., the appropriate alarm indicating means (LED and/or receiver horn 78, in this embodiment) is activated at designated receivers during the time that the operator so commands. Specifically, when an alert request is made at transmitter 20 via keypad 58 using the procedure described above, depression of the EXE key by the operator results in the transmission of an alert signal containing the specified receiver address code and the alert code continuously so long at the EXE key remains depressed. The alert signal transmitted by transmitter 20 results in the activation of the appropriate alarm indicating means. Soon after the operator ceases to depress the EXE key, the alert signal is no longer transmitted via transmitter 20 and the alarm indicating means is deactivated by receiver 22. Similarly, when an alert request is made via telecommunications system 48 using the remote procedure described above, the appropriate alarm indicating means is activated during the time the "*" button on the operator's telephone is depressed by the operator. Thus, the EXE key of keypad 58 and the "*" key of the operator's telephone are manually actuable switches used to initiate the transmission of a continuous alert signal from transmitter 20 over the cable system network.

The interactive feature of the alert system of the present invention may be preferable over a system in which the receiver activates an alarm indicating means, such as a light or an audible alarm, for a specified period of time or intermittently over a specified period of time. Because the alert system is interactive, the recipient will not be annoyed by the continued activation of an alarm that is no longer necessary. It is conceivable, however, that such a timing mechanism for activation of the alarm indicating means is desired. If so, such a timed activation is considered to be within the scope of the invention.

It will also be appreciated that the alert system of the present invention may be modified to handle numerous types of emergencies, or that different alert codes and alarm indicating means therefor may be appropriate for different geographic regions. The use of an alert code provides a great deal of flexibility in the types of emergencies to which the recipient is alerted. The software executing on microprocessor 60 of transmitter 20 and the software of microprocessor 76 of receiver 22 may be easily modified to accept, transmit and receive number alert codes. Also, additional alarm indicating means may be included with receiver 22 to accommodate various alert codes.

It will be further appreciated that various types of alarm indicating means may be utilized with the receiver of the alert system of the present invention. If the recipient is hearing impaired, perhaps only visual alarm indicating means may be provided. For a visually impaired recipient, audible alarm indicating means are preferable. The receiver may also be useful in the event of a power outage if a battery powered light such as DC powered light 74 in the embodiment of FIG. 5, may be attached to the receiver. DC power light 74 may be utilized by the recipient as a light. Further, DC powered light 74 may be electrically connected to digital receiver circuit 30 so that it too is activated in the event of a power outage.

While this invention has been described as having a preferred design, the present invention can be further modified within the spirit and scope of this disclosure. This application is therefore intended to cover any variations, uses or adaptations of the invention using its general principles. Further, this application is intended to cover such departures from the present disclosure as come within known or customary practice in the art to which this invention pertains and which fall within the limits of the appended claims.

What is claimed is:

1. An alert system for use in a cable system network, the cable system network comprising a plurality of cables over which communication signals are transmitted from a central transmission station to a plurality of receivers, each communication signal having associated therewith at least one distinguishable modulation frequency, the alert system comprising: means for generating an alert request in response to an emergency condition affecting at least two recipients, means located at said central transmission station for receiving an alert request;

a transmitter located at said central transmission station having an input operatively connected to said request receiving means and an output coupled with the cable system network, said transmitter output providing an alert signal modulated at a frequency distinguishable from the frequencies of the communication signals in response to said alert request;

a manual actuator operatively connected to said transmitter, said transmitter providing a continuous alert signal in response to said alert request and activation of said manual actuator;

one of said plurality of receivers coupled with the cable system network, said receiver including means for detecting said alert signal and generating an alarm signal therefrom; and an alarm connected to said detecting means, said alarm activated in response to said alarm signal.

2. The system of claim 1, wherein said receiver has associated therewith a receiver address code, said alert request includes a specified receiver address code, said alert signal includes an address code corresponding to said specified receiver address code, said detecting means includes comparing means for comparing said address code to said receiver address code, said alarm responsive to an output of said comparing means.

3. The system of claim 1, wherein said alert request includes an alert type indication corresponding to one of a plurality of alert types, said alert signal includes an alert code corresponding to said alert type indication, said alarm includes a plurality of alarm indications, each said alarm indication responsive to one of said plurality of alert types.

4. The system of claim 1, wherein said request receiving means comprises a keypad whereby said alert request is entered using said keypad.

5. The system of claim 1, wherein said request receiving means comprises telephonic means for accepting said alert request through an incoming telephone call.

6. The system of claim 5, wherein said telephonic means includes telephone receiving means for receiving an incoming telephone call, prompting means for prompting a caller to enter appropriate codes, and converting means for converting said appropriate codes into said alert request.

7. The system of claim 1, further comprising a request alarm operatively connected to said request receiving means, said request alarm activated by receipt of said alert request.

8. The system of claim 1, wherein said request receiving means further comprises a security means for requiring entry of a valid security code prior to accepting entry of said alert request.

9. The system of claim 1, further comprising a battery connected to said receiver and said alarm.

10. The system of claim 1, wherein said alert signal modulation frequency is around 72.5 megahertz.

11. The system of claim 1, wherein said alarm comprises an audible alarm.

12. The system of claim 1, wherein said alarm comprises a visual display.

13. The system of claim 1, wherein said transmitter comprises a sideband filter connected to said transmitter output and coupled to said cable system network, whereby subharmonics around said frequency distinguishable from the frequencies of the communication signals are reduced by said sideband filter.

14. A method for alerting recipients of an emergency comprising the steps of:

generating an alert request in response to said emergency affecting at least two recipients, providing a cable system network over which a plurality of communication signals are transmitted at respective distinguishable frequencies, a central alert request receiver, a central transmitter, a plurality of receivers and an alarm operatively coupled together;

receiving said alert request and generating an alert signal in response thereto with the alert request receiver;

transmitting the alert signal over the cable system network by initiating the transmission of an alert signal with a manually actuated switch and continuously transmitting the alert signal;

receiving the alert signal with one of said plurality of receivers; and activating the alarm in response to the received alert signal.

15. The method of claim 14, wherein said step of transmitting the alert signal comprises transmitting an alert signal with an address code which specifies a geographic location and an alert type indication which specifies an alert type, said step of receiving an alert request comprises receiving the address code and the alert type indication, said step of activating an alarm comprises activating the alarm in response to the received alert signal, the address code, and the alert type.

16. An alert system comprising:

a cable system central network having a cable system transmitter connected to a plurality of receiving devices through a transmitting medium, said transmitter transmitting a plurality of communication signals, each said communication signal having associated therewith at least one distinguishable modulation frequency:

means for generating a alert request in response to an emergency condition affecting at least two recipients, means for receiving said alert request;

a central transmitter having an input operatively connected to the request receiving means and an output coupled with said cable system network, said transmitter output providing an alert signal modulated at a frequency distinguishable from the frequencies of said communication signals in response to said alert request;

a receiver coupled with said cable system network, said receiver including means for detecting said alert signal and generating an alarm signal therefrom; and an alarm connected to said detecting means, said alarm responsive to said alert signal.

17. The system of claim 16, wherein said transmitting medium comprises a co-axial cable.

18. The system of claim 17, wherein said transmitting medium comprises microwave transmission media.

19. An alert system for use in a cable system network, over which communication signals are transmitted to recipients, for alerting a plurality of network recipients about an impending emergency condition, the alert system compromising:

means generating a signal in response to said emergency condition affecting at least two recipients, means located at a central transmission stations for receiving an alert signal from a source remote from said recipients, a transmitter located at said central transmission station having an input operatively connected to said request receiving means and an output coupled with the cable system network, said transmitter output providing an alert signal modulated at a frequency distinguishable from the frequencies of the communication signals in response to said emergency condition.

* * * * *